US005592972A

United States Patent [19]

Niethammer

[11] Patent Number: 5,592,972

[45] Date of Patent: Jan. 14, 1997

[54] ELECTROPROPORTIONAL SOLENOID VALVE UNIT

[75] Inventor: Bernd Niethammer, Nürtingen, Germany

[73] Assignee: Hydraulik-Ring Antriebs- und Steuerungstechnik GmbH, Nurtingen, Germany

[21] Appl. No.: 386,372

[22] Filed: Feb. 10, 1995

[30] Foreign Application Priority Data

Feb. 10, 1994 [DE] Germany ..... 94 02 206.2

[51] Int. Cl.[6] ..... F15B 13/044

[52] U.S. Cl. ..... 137/625.65; 137/625.68; 251/129.07

[58] Field of Search ..... 137/625.65, 625.68; 251/129.07

[56] References Cited

U.S. PATENT DOCUMENTS 4,491,153 1/1985 Barthomaus ..... 137/625.65

5,117,869 6/1992 Kolchinsky ..... 137/625.65

*Primary Examiner*—Gerald A. Michalsky

*Attorney, Agent, or Firm*—Robert W. Becker & Associates

[57] ABSTRACT

An electroproportional solenoid valve unit has a valve housing with hydraulic connectors for a hydraulic medium. A piston with a hollow interior is positioned in the valve housing and is slidable therein. A pressure spring is arranged at one end of the piston. A solenoid is connected to the valve housing and cooperates with the other end of the piston for moving the piston counter to the force of the spring. A first hydraulic chamber is located at the first end of the piston and a second hydraulic piston is located at the second end of the piston. The piston has a first annular channel adjacent to the first hydraulic chamber and a second annular channel adjacent to the second hydraulic chamber. The first and second annular channels are connectable to the hydraulic connectors. The second hydraulic chamber facing the solenoid is separated from the hollow interior of the piston and from the second annular channel. The first annular channel is connected to the hollow interior of the piston with at least one opening.

6 Claims, 1 Drawing Sheet

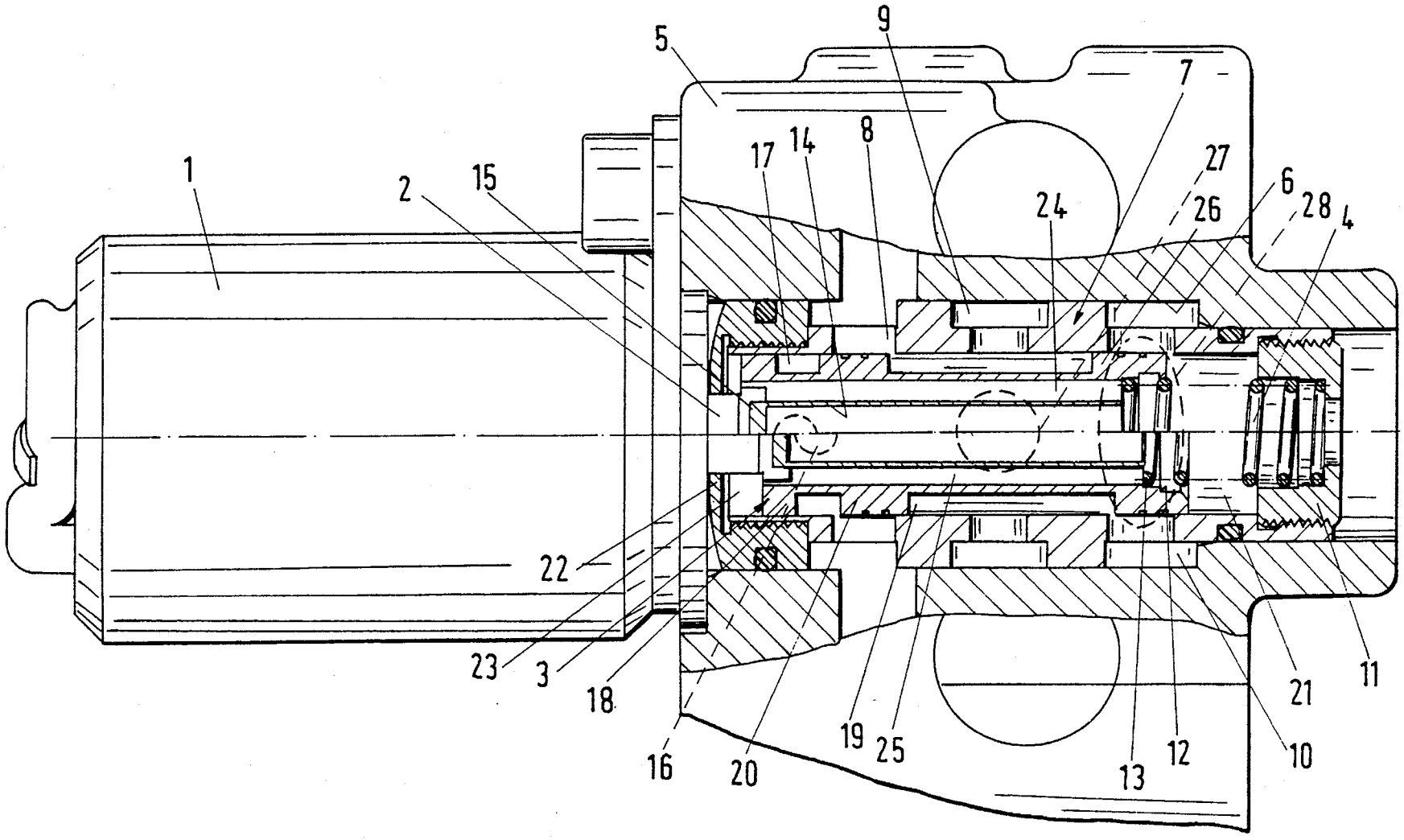
1
2
15
5
17
14
8
9
24
7
27
26
6
28
4
22
23
3
18
16
20
19
25
13
12
10
21
11

ELECTROPROPORTIONAL SOLENOID VALVE UNIT

BACKGROUND OF THE INVENTION

The present invention relates to an electroproportional solenoid valve unit having a valve housing in which a piston is slidably arranged so as to be displacable by the push rod of a solenoid. The piston is in the form of a hollow piston and on either end of the piston a hydraulic chamber is provided. The piston also has two annular channels that can be connected to hydraulic connectors of the valve housing.

When the solenoid is excited in this known valve device, the piston in the form of a hollow piston is displaced against the force of a pressure spring. This action leads to the opening of one of the hydraulic connectors to the consuming device to be activated so that the hydraulic medium can flow via this open hydraulic connector to the consuming device. The hydraulic medium being displaced from this consuming device is transferred to the other hydraulic connector and flows from there into the hollow interior of the piston. From there the hydraulic medium flows back into the reservoir. At the end face of the piston which is facing the solenoid a hydraulic pressure is generated in the hydraulic chamber as a function of the volume of the hydraulic medium flowing through the hollow interior of the piston limited by its diameter. The hydraulic pressure thus generated is greater than the pressure which acts on the opposite end face of the piston. Accordingly, with increasing amperage, with which the solenoid loads the corresponding control edges, the position of the piston and the flow of the hydraulic medium is changed. As soon as a critical throughflow value is passed, a sudden change of the piston position occurs due to the pressure forces which act on the end face of the piston facing the solenoid and add to the magnetic force. Below this critical throughflow value the throughflow/amperage characteristic line still follows the desired course. Above this critical value however a sudden undesired change of the flow volume occurs.

It is therefore an object of the present invention to improve an electroproportional solenoid valve unit of the aforementioned kind such that the throughflow volume of the hydraulic medium changes continuously as a function of the amperage with which the solenoid is loaded.

SUMMARY OF THE INVENTION

The electroproportional solenoid valve unit of the present invention is primarily characterized by:

A valve housing with hydraulic connectors for a hydraulic medium;

A piston with a hollow interior, the piston positioned in the valve housing so as to be slidable;

A pressure spring positioned at one end of the piston;

A solenoid connected to the valve housing and cooperating with the other end of the piston for moving the piston counter to the force of the spring;

A first hydraulic chamber located at the first end of the piston and a second hydraulic chamber located at the second end of the piston;

The piston having a first annular channel adjacent to the first hydraulic chamber and a second annular channel adjacent to the hydraulic chamber, the first and second annular channels connectable to the hydraulic connectors;

The second hydraulic chamber facing the solenoid being separated from the hollow interior of the piston and from the second annular channel; and The first annular channel connected to the hollow interior of the piston with at least one opening.

Preferably, the hollow interior of the piston has a bottom and the push rod of the solenoid rests at the bottom.

Advantageously, the valve unit further comprises at least one compensation line connecting the first and the second hydraulic chambers.

Advantageously, the compensation line is located in the piston.

In a preferred embodiment of the present invention the compensation line is an axially extending bore in the piston.

Preferably, the one end of the piston has a recess for receiving the pressure spring.

In the inventive valve unit the hydraulic chamber adjacent to the solenoid is separated from the neighboring annular channel of the piston and from the piston interior. Accordingly, a hydraulic pressure can be formed within this hydraulic chamber. The hydraulic medium coming from the consuming device to be controlled can enter the annular channel in a corresponding position of the piston and can flow from there via the opening into the hollow interior of the piston. The hollow piston interior is separated from the hydraulic chamber so that the displaced hydraulic medium cannot enter this hydraulic chamber. Thus, in a constructively simple manner a hydraulic pressure in this hydraulic chamber is avoided. Accordingly, the throughflow/amperage characteristic line of this valve unit changes, as desired, continuously, and no sudden changes of the throughflow volume do occur. It is accordingly ensured that over the entire characteristic line the consuming device to be controlled is reliably actuated.

BRIEF DESCRIPTION OF THE DRAWING

The object and advantages of the present invention will appear more clearly from the following specification in conjunction with the accompanying drawing, in which in a longitudinal section and partly in an elevated view the inventive electroproportional solenoid valve unit is shown. In the upper half of the drawing the piston of the valve unit is shown in its initial position and in the lower half of the drawing the piston is shown in the position into which it is displaced by the push rod of the solenoid.

DESCRIPTION OF PREFERRED EMBODIMENTS

The electroproportional solenoid valve unit has an electromagnet (solenoid) 1 with a push rod 2 that rests at a piston 3. The piston 3 is biased by the force of a pressure spring 4 against the push rod 2.

The solenoid 1 is of a conventional design and is therefore not explained in detail. It is connected to a casing 5 that comprises a receiving chamber 6 for the valve housing 7. In the valve housing 7 the piston 3 is positioned so as to be slidable in the longitudinal direction. The valve housing 7 has hydraulic connectors 8, 9, 10 via which, controlled by the piston 3, hydraulic medium can be conveyed to and from the consuming device. The consuming device as well as the reservoir for the hydraulic medium are connected in a conventional manner to the casing 5.

The pressure spring 4 is supported at the adjusting screw 11 provided at the valve housing 7. By turning the adjusting screw 11 into different positions within the valve housing 7, the pretension of the pressure spring 4 and thus the position of the piston 3 relative to the magnetic force can be adjusted continuously. The adjusting screw 11 has a through opening via which the hydraulic medium can return to the reservoir.

The piston 3 is provided with a recess 12 at its end facing the adjusting screw 11. The pressure spring 4 is supported at the bottom 13 of the recess 12. The piston 3 has a central bore 14 extending in its axial direction. In the direction toward the push rod 2 of the solenoid 1 the central bore 14 is closed off by a bottom 15. The push rod 2 of the solenoid 1 rests at this bottom 15. Into the bore 14 of the piston 3 a radially extending opening 16 opens via which the hydraulic medium can reach the bore 14 of the piston 3.

The exterior of the piston is provided with an annular channel 17 which is closed off toward the solenoid 1 by an annular stay 18. The piston 3 has a further annular channel 19 which is substantially longer than the annular channel 17 and is separated from the annular channel 17 by an annular stay 20.

In the left end position of the piston 3, which is represented in the upper half of the drawing, the hydraulic connector 10 is open to the hydraulic chamber 21 in which the pressure spring 4 is positioned and into which the central bore 14 of the piston 3 opens. Via the radially extending opening 16 the central bore 14 connected to the annular channel 17 of the piston 3 into which the opening 16 opens. In this left end position of the piston 3 the hydraulic connector 8 is also connected to the annular channel 19 of the piston 3. Since the connector 9 is also connected to the annular channel 19 and is furthermore connected via a connector 27 of the casing 5 to the non-represented pump of the hydraulic system, a connection between the hydraulic connector 8 and the pressure connector 9 is provided. The other hydraulic connector 10 of the valve housing 7 is not closed off in this left end position of the piston so that a connection to the hydraulic chamber 21 is provided.

As shown in the drawing, the piston 3 in the left end position is spaced from the bottom 22 of the valve housing 7. By this measure, a further hydraulic chamber 23 is formed between the piston 3 and the bottom 22. This chamber 23 is connected with at least one bore 24 that axially penetrates the piston 3 to the oppositely arranged hydraulic chamber 21. This bore 24 should not be in connection with the opening 16. In the shown embodiment, the piston 3 has a further bore 25 that also axially penetrates the piston and connects the two hydraulic chambers 21 and 23.

Connected to the hydraulic connectors 8 and 10 of the valve housing 7 is a consuming device to be controlled with the valve unit. For example, this consuming device is in the form of a piston/cylinder unit. When it is desired to actuate this consuming device, the electromagnet (solenoid) 1 is turned on so that the push rod 2 is extended. The push rod 2 thus displaces the piston 3 counter to the force of the pressure spring 4. Upon displacement of the piston 3, the connection between the hydraulic connector 9 and the hydraulic connector 8 is closed off, while the connection between the hydraulic connector 10 and the pressure connector 9 is opened. Thus, the pressurized hydraulic medium can flow via the pressure connector 9 and the annular channel 19 to the hydraulic connector 10 from where it flows via the connector 28 of the casing 5 to the consuming device in order to actuate it as desired. The hydraulic medium which is displaced from the consuming device to be controlled can be returned to the reservoir via the hydraulic connector 8, the annular channel 17, the opening 16, the bore 14 of the piston 3, the hydraulic chamber 21, and the through opening of the adjusting screw 11. When the control electronic device recognizes that the desired position of the control member of the consuming device to be controlled has been reached, the control amperage is reduced. Thus, the magnetic force is reduced and the piston 3 is returned by the force of the pressure spring 5 into its central position in which the two annular stays 20 and 26 of the piston 3 close off the two hydraulic connectors 8 and 10. Accordingly, the pressure of the hydraulic medium within the consuming device is maintained.

When the solenoid 1 is switched off, the piston 3 is returned under the force of the pressure spring 4 into the left end position represented in the drawing whereby the push rod 2 is returned into the housing of the solenoid 1. The connection between the hydraulic connector 10 and the pressure connector 9 is closed, while the connection between the hydraulic connector 8 and the pressure connector 9 is open via the piston 3. Thus, the pressurized hydraulic medium can reach via the hydraulic connector 10 the piston of the consuming device to be controlled and can return it.

Via the two bores 24 and 25 within the piston 3, a pressure compensation between the two hydraulic chambers 21, 23 at both ends of the piston 3 is achieved in a simple manner. Thus at both ends of the piston 3 the pressure is equal. The hydraulic medium practically does not flow in the two bores 24, 25 of the piston 3, instead, a static pressure is generated. The hydraulic medium in front of the piston 3 (in the direction of movement) is simply displaced upon displacement of the piston via the bores 24, 25. Thus, this design provides for a certain damping of the piston 3 during its displacement stroke.

The bores 24, 25 in the shown embodiment have a smaller cross-section than the central bore 14. The bores 14, 24, 25 may also have the same diameter. Also, it is possible that the two compensation bores 24, 25 have a greater diameter than the central bore 14 of the piston 3.

In order to provide such bores 24, 25, it is also possible to insert into the hollow interior of the piston 3 a bushing. In such a design, the exterior wall of such a bushing and/or the interior wall of the bore of the piston is provided with a recess or groove that extends continuously over the length of the piston or bushing.

Since the hydraulic chamber 23 is separated by the annular stay 18 of the piston 3 from the annular channel 17, the hydraulic medium, displaced from the consuming device to be controlled via the hydraulic connector 8, can only flow via the annular channel 17 and the opening 16 into the bore 14 of the piston 3 and is returned from there to the reservoir. The central bore 14 of the piston 3 is separated from the hydraulic chamber 23 by the bottom 15. Thus, the pressure differences occurring during displacement of the piston 3 do not affect the switching behavior of the valve unit so that the desired characteristic line can be achieved. The throughflow volume of the hydraulic medium changes continuously in the amount that is required as a function of the amperage with which the solenoid 1 is loaded.

The present invention is, of course, in no way restricted to the specific disclosure of the specification and drawings, but also encompasses any modifications within the scope of the appended claims.

What I claim is:

1. An electroproportional solenoid valve unit comprising:

a valve housing with hydraulic connectors for a hydraulic medium;

a piston with a hollow interior, said piston positioned in said valve housing so as to be slidable;

a pressure spring positioned at a first end of said piston;

a solenoid connected to said valve housing and cooperating with a second end of said piston for moving said piston counter to the force of said spring;

a first hydraulic chamber located at said first end of said piston and a second hydraulic chamber located at said second end of said piston;

said piston having a first annular channel adjacent to said first hydraulic chamber and a second annular channel adjacent to said second hydraulic chamber, said first and second annular channels connectable to said hydraulic connectors;

said second hydraulic chamber facing said solenoid being separated from said hollow interior of said piston and from said second annular channel so that the hydraulic medium in said piston cannot enter said second hydraulic chamber; and said second annular channel connected to said hollow interior of said piston with at least one opening.

2. A valve unit according to claim 1, wherein said hollow interior of said piston has a bottom and wherein said solenoid has a push rod resting at said bottom.

3. A valve unit according to claim 1, further comprising at least one compensation line connecting said first and said second hydraulic chambers.

4. A valve unit according to claim 3, wherein said compensation line is located in said piston.

5. A valve unit according to claim 3, wherein said compensation line is an axially extending bore in said piston.

6. A valve unit according to claim 1, wherein said one end of said piston has a recess for receiving said pressure spring.

* * * * *